US009500984B2

(12) United States Patent
Namiki et al.

(10) Patent No.: US 9,500,984 B2
(45) Date of Patent: Nov. 22, 2016

(54) TONER SUPPLY DEVICE AND IMAGE FORMING APPARATUS

(71) Applicant: KONICA MINOLTA, INC., Chiyoda-ku, Tokyo (JP)

(72) Inventors: Takaaki Namiki, Toyokawa (JP); Isao Kawakami, Gamagori (JP); Youichi Itagaki, Toyokawa (JP); Sho Karakama, Toyokawa (JP); Shogo Asaoka, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/106,420

(22) Filed: Dec. 13, 2013

(65) Prior Publication Data

US 2014/0169834 A1 Jun. 19, 2014

(30) Foreign Application Priority Data

Dec. 19, 2012 (JP) ..... 2012-276845

(51) Int. Cl.
*G03G 15/08* (2006.01)

(52) U.S. Cl.
CPC .. *G03G 15/0865* (2013.01); *G03G 2215/0827* (2013.01)

(58) Field of Classification Search
CPC ..... G03G 15/0832; G03G 15/0839; G03G 15/0865; G03G 15/0875; G03G 15/0877
USPC ..... 399/258, 262, 263
See application file for complete search history.

(56) References Cited

U.S. PATENT DOCUMENTS

| | | | | |
|---|---|---|---|---|
| 5,017,966 | A * | 5/1991 | Suga | 399/261 |
| 5,758,231 | A | 5/1998 | Coffey et al. | |
| 2008/0175629 | A1* | 7/2008 | Eto et al. | 399/262 |

FOREIGN PATENT DOCUMENTS

| | | | |
|---|---|---|---|
| JP | 09-15957 | A | 1/1997 |
| JP | 10-198152 | A | 7/1998 |
| JP | 2000-047464 | A | 2/2000 |
| JP | 2004-012925 | A | 1/2004 |
| JP | 2010096827 | A | 4/2010 |
| JP | 2010191087 | A | 9/2010 |

OTHER PUBLICATIONS

Japanese Office Action dated Feb. 4, 2015, issued in counterpart Japanese Application No. 2012-276845.

* cited by examiner

*Primary Examiner* — David Gray
*Assistant Examiner* — Thomas Giampaolo, II
(74) *Attorney, Agent, or Firm* — Holtz, Holtz & Volek PC

(57) ABSTRACT

A toner supply device includes a toner storage, a supply opening, a toner conveyer, a toner supply opening, and an air passage. The toner storage stores toner. Through the supply opening, the toner is supplied to a developing device. The toner conveyer includes an area of space different from an area of space of the toner storage. The toner conveyer conveys the toner stored in the toner storage to supply the toner from the supply opening to the developing device. Through the toner supply opening, the toner is supplied from the toner storage to the toner conveyer. The air passage is at a position different from the toner supply opening. The air passage connects the toner storage to the toner conveyer so as to allow air flowing through the supply opening into the toner conveyer to be supplied to the toner storage through the air passage.

11 Claims, 5 Drawing Sheets

TONER SUPPLY DEVICE AND IMAGE FORMING APPARATUS

CROSS-REFERENCE TO RELATED APPLICATIONS

The present application claims priority under 35 U.S.C. §119 to Japanese Patent Application No. 2012-276845, filed Dec. 19, 2012. The contents of this application are incorporated herein by reference in their entirety.

BACKGROUND OF THE INVENTION

1. Field of the Invention

The present invention relates to a toner supply device and an image forming apparatus.

2. Discussion of the Background

Electrophotographic image forming apparatuses include a photoreceptor unit. The photoreceptor unit includes a photosensitive drum and a developing device. On the photosensitive drum, an electrostatic latent image is to be formed, and the developing device attaches toner to the photosensitive drum. Every formation of an image on a recording sheet of paper involves conveyance of a toner image formed on the photosensitive drum to the recording sheet of paper, and this reduces the toner in the developing device. In order to eliminate depletion of toner in the developing device, some of the image forming apparatuses are provided with a toner supply device to supply toner to the developing device.

Japanese Unexamined Patent Application Publication No. 9-015957 discloses a toner supply device that is disposed outside the image forming apparatus. In order to ensure toner conveyance ability to the developing device, the toner supply device uses an air pump to send air to a toner conveyance path provided with a conveyance screw. Japanese Unexamined Patent Application Publication No. 10-198152 discloses a toner cartridge (which corresponds to the toner supply device) that is integral with the developing device. In order to prevent pressure on the inside of the cartridge due to external air taken in by the developing device, the toner cartridge is provided with an air hole on a plug that is engaged with a side surface of a hopper that stores toner to be supplied to the developing device.

Japanese Unexamined Patent Application Publication No. 2000-047464 discloses a volume reducible toner container (which corresponds to the toner supply device). In order to ensure stable supply of toner stored in the toner container, the toner container is provided with an air supplier separate from a toner discharger. The air supplier accepts supply of air from an air pump. Japanese Unexamined Patent Application Publication No. 2004-012925 discloses a toner cartridge (which corresponds to the toner supply device) that is provided with an air hole on a connecting material connected to a toner conveyance member that conveys toner to the developing device.

SUMMARY OF THE INVENTION

According to one aspect of the present invention, a toner supply device includes a toner storage, a supply opening, a toner conveyer, a toner supply opening, and an air passage. The toner storage is configured to store toner. Through the supply opening, the toner is supplied to a developing device. The toner conveyer includes an area of space different from an area of space of the toner storage. The toner conveyer is configured to convey the toner stored in the toner storage so as to supply the toner from the supply opening to the developing device. Through the toner supply opening, the toner is supplied from the toner storage to the toner conveyer. The air passage is disposed at a position different from a position at which the toner supply opening is disposed. The air passage connects the area of space of the toner storage and the area of space of the toner conveyer to one another so as to allow air flowing through the supply opening into the toner conveyer to be supplied to the toner storage through the air passage.

According to another aspect of the present invention, an image forming apparatus includes the above-described toner supply device.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
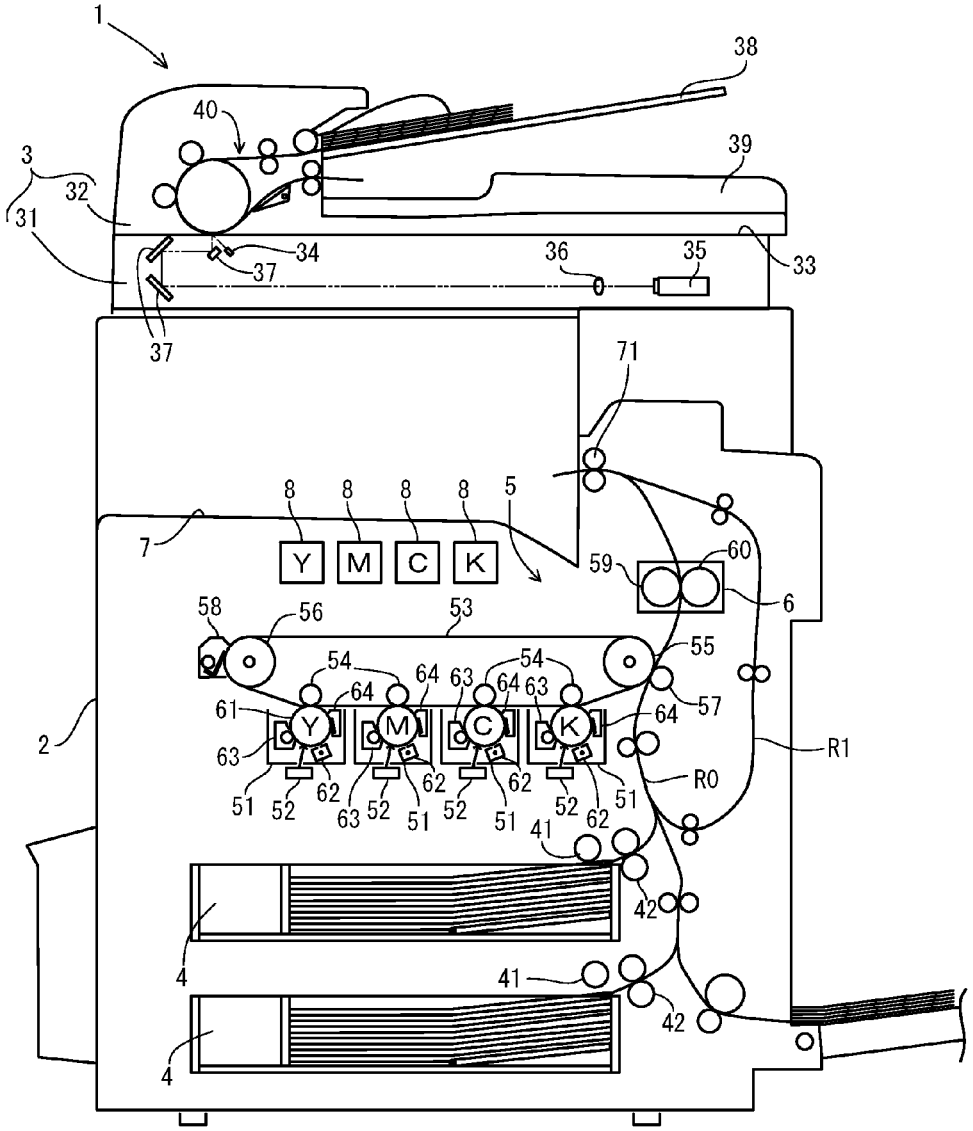
FIG. 1 is a view of an image forming apparatus according to an embodiment of the present invention, illustrating an internal configuration of the image forming apparatus.

The embodiments will now be described with reference to the accompanying drawings, wherein like reference numerals designate corresponding or identical elements throughout the various drawings.

General Arrangement of the Image Forming Apparatus

A general arrangement of the image forming apparatus common to the following embodiments will be described by referring to the accompanying drawings. FIG. 1 is a view of an image forming apparatus according to an embodiment of the present invention, illustrating an internal configuration of the image forming apparatus.

As shown in FIG. 1, an image forming apparatus 1 includes an image reader 3, feeders 4, an image formation unit 5, a fixing device 6, a discharge tray 7, and toner supply devices 8. The image reader 3 reads an image from a document. The feeders 4 store recording sheets of paper to bear an image. After a toner image has been formed, the image formation unit 5 conveys the toner image to a recording sheet of paper fed from any of the feeders 4. The fixing device 6 fixes the toner image transferred on the recording sheet of paper at the image formation unit 5. On the discharge tray 7, the recording sheet of paper on which an image is formed through the fixing at the fixing device 6 is discharged. The toner supply devices 8 supply toner to respective developing devices 63 disposed in the image formation unit 5. The image forming apparatus 1 has an apparatus main body 2, and the image reader 3 is disposed above the apparatus main body 2. As shown in FIG. 1, in the apparatus main body 2, the feeders 4, the image formation unit 5, and the fixing device 6 are disposed in ascending order from the bottom.

The discharge tray 7 is disposed above the apparatus main body 2 to receive a discharge of a recording sheet of paper on which an image has been formed at the fixing device 6. The feeders 4 are removably disposed below the image formation unit 5 in the apparatus main body 2. With this configuration, a recording sheet of paper stored in any of the feeders 4 is fed into the apparatus main body 2, and then conveyed in the upward direction to bear an image at the image formation unit 5 and the fixing device 6, which are disposed above the feeders 4. Then, the recording sheet of paper is discharged onto the discharge tray 7, which defines an area of space (depressed space) disposed below the image reader 3.

The image reader 3 is disposed above the apparatus main body 2, and includes a scanner 31 and an auto document feeder (ADF) 32. The scanner 31 reads an image from a document. The ADF 32 is disposed above the scanner 31 and conveys one document P1 at a time to the scanner 31. The scanner 31 includes a platen 33, an optical source device 34, an image sensor 35, an imaging lens 36, and a mirror group 37. The platen 33 has platen glass (not shown) on its upper surface. The optical source device 34 radiates light to the document P1. The image sensor 35 photoelectrically converts reflection light from the document into image data. The imaging lens 36 forms the reflection light into an image on the image sensor 35. The mirror group 37 sequentially reflects the reflection light from the document to make the reflection light incident on the imaging lens 36. The ADF 32 includes a document tray 38 and a document discharge tray 39, and is openable and closable over the scanner 31 relative to the platen 33.

When the image reader 3 reads a document placed on the platen glass (not shown) of the platen 33, the optical source device 34 moves in a vertical scanning direction and radiates light to the document. Resulting reflection light is formed into an image on the image sensor 35 through the mirror group 37 and the imaging lens 36. Then, the image sensor 35 generates an electrical signal that is based on the reflection light from the document, and outputs the electrical signal as image data. When the image reader 3 reads a document placed on the document tray 38, the optical source device 34 and the mirror group 37 are fixed at their respective predetermined positions in the platen 33, and the document is conveyed to its reading position through a document conveyance mechanism 40, which is made up of a plurality of rollers and other elements. Thus, the light from the optical source device 34 is radiated to the document conveyed through the document conveyance mechanism 40, and the resulting reflection light is formed into an image on the image sensor 35, followed by output of image data.

The image formation unit 5 includes image formation sections 51, exposure devices 52, an intermediate transfer belt 53, primary transfer rollers 54, a drive roller 55, an idler roller 56, a secondary transfer roller 57, and a cleaner 58. The image formation sections 51 respectively generate toner images of Y (Yellow), M (Magenta), C (Cyan), and K (Key tone). The exposure devices 52 are disposed under the respective image formation sections 51. The intermediate transfer belt 53 contacts the image formation sections 51, which are arranged in the horizontal direction to be dedicated to the respective colors, so as to receive the toner images of the respective colors from the image formation sections 51. The primary transfer rollers 54 are disposed above and opposed to the respective image formation sections 51, which are dedicated to the respective colors, across the intermediate transfer belt 53. The drive roller 55 turns the intermediate transfer belt 53 into movement. The idler roller 56 is rotated by the rotation of the drive roller 55 transmitted through the intermediate transfer belt 53. The secondary transfer roller 57 is opposed to the drive roller 55 across the intermediate transfer belt 53. The cleaner 58 is opposed to the idler roller 56 across the intermediate transfer belt 53.

The image formation sections 51 each include a photosensitive drum 61, a charging device 62, the developing device 63, and a cleaner 64. The photosensitive drum 61 is in contact with the outer circumference surface of the intermediate transfer belt 53. The charging device 62 charges the outer circumference surface of the photosensitive drum 61 by corona discharge. The developing device 63 attaches stirred and charged toner to the outer circumference surface of the photosensitive drum 61. The cleaner 64 removes residual toner that remains on the outer circumference surface of the photosensitive drum 61 after the toner image has been transferred to the intermediate transfer belt 53. Here, the photosensitive drum 61 is opposed to the corresponding primary transfer roller 54 across the intermediate transfer belt 53, and rotates in the clockwise direction in FIG. 1. The photosensitive drum 61 is surrounded by the primary transfer roller 54, the cleaner 64, the charging device 62, the exposure device 52, and the developing device 63 in the direction of rotation of the photosensitive drum 61.

The intermediate transfer belt 53 is made of, for example, a conductive, seamless belt member, and is tensely looped across the drive roller 55 and the idler roller 56. This ensures that the rotation of the drive roller 55 turns the intermediate transfer belt 53 into movement in the anti-clockwise direction in FIG. 1. The intermediate transfer belt 53 is surrounded by the secondary transfer roller 57, the cleaner 58, and the image formation sections 51, which are respectively dedicated to the colors of YMCK, in this order in the direction of rotation of the intermediate transfer belt 53.

The fixing device 6 includes a heating roller 59 and a pressure roller 60. The heating roller 59 includes a halogen lamp or a similar device to heat and fix the toner image on the recording sheet of paper. The pressure roller 60 cooperates with the heating roller 59 to hold the recording sheet of paper under pressure. The heating roller 59 may use electromagnetic induction to cause an eddy current on the surface of the heating roller 59 so as to heat the surface of the heating roller 59. Above the intermediate transfer belt 53, the toner supply devices 8 are disposed. The toner supply devices 8 store toner of the respective colors of YMCK to be supplied to the developing devices 63. The toner supply devices 8 respectively correspond to the colors of YMCK, and are connected to the developing devices 63 of the respective colors of YMCK through toner conveyance members, not shown. Through the toner conveyance members, the toner supply devices 8 supply toner to the developing devices 63.

A feeding mechanism takes out one recording sheet of paper at a time from the feeders 4. The feeding mechanism includes a feeding roller 41 and a separate roller pair 42. The feeding roller 41 feeds the top of the paper stored in the feeders 4. The separate roller pair 42 separates the fed paper into individual recording sheets of paper. By the driving rotation of the feeding roller 41 and the separate roller pair 42, the recording sheets of paper stored in the feeders 4 are forwarded, one at a time starting at the top, toward a main conveyance path R0. At a position on the main conveyance path R0 further downstream than the fixing device 6, a discharge roller pair 71 is disposed. The discharge roller pair 71 discharges a printed recording sheet of paper. By the driving rotation of the discharge roller pair 71, the printed recording sheet of paper is discharged onto the discharge tray 7.

Thus, various elements are disposed in the apparatus main body 2 of the image forming apparatus 1. Further in the apparatus main body 2, a circulation conveyance path R1 is disposed. The circulation conveyance path R1 is used to turn over a recording sheet of paper printed on one side so as to have the recording sheet of paper printed on the other side. The discharge roller pair 71 is capable of forward-reversal rotation. By the forward-reversal rotation of the discharge roller pair 71, the recording sheet of paper can be discharged outside the apparatus main body 2 onto the discharge tray 7, or switched (reversed) back into the circulation conveyance path R1 in the apparatus main body 2.

A printing operation by the image forming apparatus 1 will be briefly described. The image forming apparatus 1 receives a starting signal, an image signal, and other signals to start a printing operation. When the printing operation starts, a recording sheet of paper fed from the feeders 4 is conveyed to an image conveyer 5 along the main conveyance path R0. At the image formation sections 51, which are dedicated to the respective colors of YMCK, of the image conveyer 5, the charging device 62 charges the surface of the photosensitive drum 61, and the exposure device 52 radiates laser light to the charged surface of the photosensitive drum 61. Thus, electrostatic latent images respectively corresponding to images of the colors of YMCK are formed. Toner charged by the developing device 63 moves to the surface of the photosensitive drum 61 on which the electrostatic latent image is formed. Thus, a toner image is formed on the photosensitive drum 61. Then, the toner image carried on the surface of the photosensitive drum 61 is brought into contact with the intermediate transfer belt 53 and transferred to the intermediate transfer belt 53 by the electrostatic force of the primary transfer roller 54. Thus, an overlapped toner image of the toner images of the colors of YMCK is formed on the surface of the intermediate transfer belt 53. After the toner image has been transferred to the intermediate transfer belt 53, untransferred toner that remains on the photosensitive drum 61 is removed off the photosensitive drum 61 by the cleaner 64.

The intermediate transfer belt 53 is rotated by the drive roller 55 and the idler roller 56, and the toner image that has been transferred to the intermediate transfer belt 53 is moved to a transfer position, where the toner image is brought into contact with the secondary transfer roller 57 and transferred to the recording sheet of paper that has been conveyed to the transfer position along the main conveyance path R0. After the toner image has been transferred to the recording sheet of paper, untransferred toner that remains on the intermediate transfer belt 53 is removed off the intermediate transfer belt 53 by the cleaner 58. The recording sheet of paper that has received the toner image from the secondary transfer roller 57 at the contact position is conveyed to the fixing device 6.

The recording sheet of paper with the unfixed toner image on one side passes through the fixing position of the fixing device 6, and thus is heated by the heating roller 59 and pressed by the pressure roller 60. Thus, the unfixed toner image is fixed on the paper surface. For simplex printing, the recording sheet of paper to which the toner image has been fixed (to which printing is done on one side) is discharged onto the discharge tray 7 through the discharge roller pair 71. For duplex printing, the recording sheet of paper to which printing on one side is done is conveyed to and turned over at the circulation conveyance path R1, which is for duplex printing. Then, the recording sheet of paper is returned to the main conveyance path R0, where the image conveyer 5 and the fixing device 6 transfer and fix a toner image to the other side of the recording sheet of paper. Then, the recording sheet of paper is discharged onto the discharge tray 7.

First Embodiment

Figure 2:
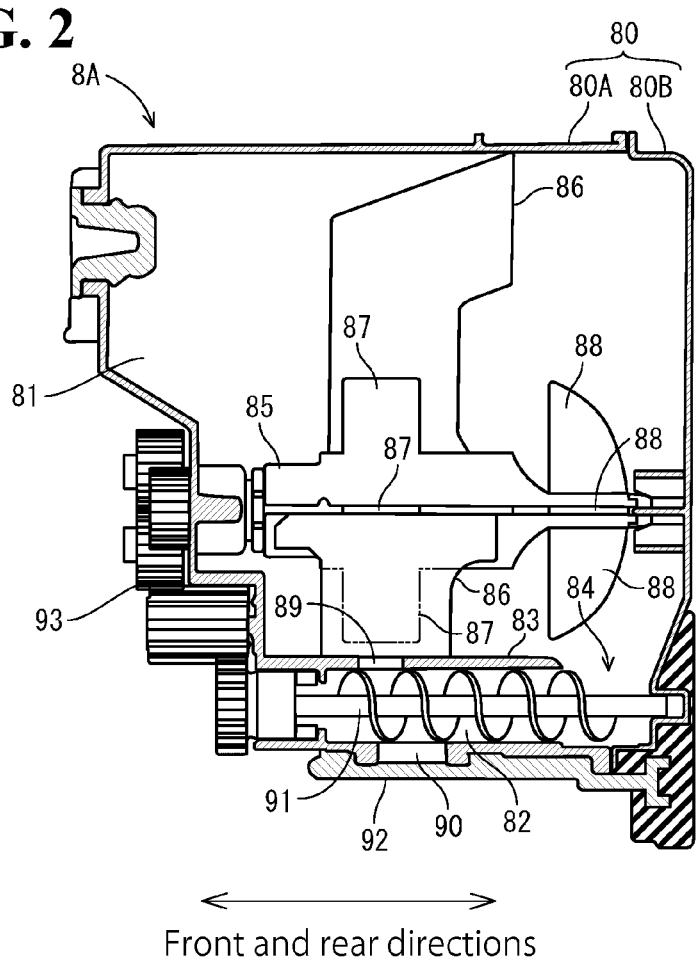
FIG. 2 is a cross-sectional view of a toner supply device of an image forming apparatus according to a first embodiment, schematically illustrating a configuration of the toner supply device.

An image forming apparatus according to the first embodiment of the present invention will be described below by referring to the accompanying drawings. The following description is mainly focused on a configuration of the toner supply device. FIG. 2 is a cross-sectional view of the toner supply device of the image forming apparatus according to the first embodiment, schematically illustrating the configuration of the toner supply device. The description of this embodiment and the following embodiments, as necessary, may refer to particular directions and positions using terms such as "left and right", "up and down (above and below or under)", and "front and rear". These terms are based on FIG. 2, where the left side of the paper surface is the front, and the direction perpendicular to the paper surface is the left-right direction.

Figure 3:
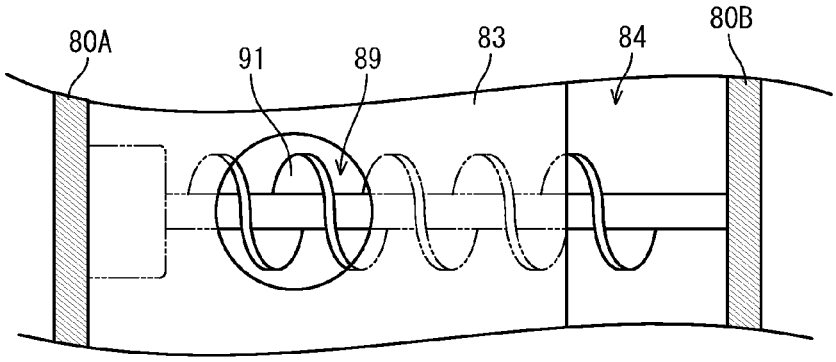
FIG. 3 is a plan view of a configuration of a partition plate in the configuration of the toner supply device shown in FIG. 2.

The image forming apparatus 1 according to this embodiment includes toner supply devices 8A each having a configuration shown in FIG. 2. The toner supply devices 8A respectively correspond to the colors of YMCK. Specifically, the toner supply devices 8A are disposed in the apparatus main body 2 of the image forming apparatus 1, and store toner of the colors of YMCK to be supplied to the developing devices 63 respectively dedicated to the colors of YMCK. A configuration of each toner supply device 8A will be described below by referring to FIGS. 2 and 3.

The toner supply device 8A is made up of a housing 80. The housing 80 includes a toner storage 81 and a toner conveyer 82. The toner storage 81 is disposed at an upper position in the housing 80 and stores toner. The toner conveyer 82 is disposed under the toner storage 81 across a partition plate 83. The housing 80 includes a front housing member 80A and a rear housing member 80B. The front housing member 80A and the rear housing member 80B are connected to one another by fitting a rear open surface of the front housing member 80A with a front open surface of the rear housing member 80B. In the front housing member 80A, the partition plate 83 extends from the front surface of the front housing member 80A toward the rear housing member 80B. Under the partition plate 83, the toner conveyer 82 is disposed.

A gap is defined between the rear end of the partition plate 83 and the rear surface of the rear housing member 80B.

This gap serves as a toner supply opening 84. The toner supply opening 84 connects the area of space defined by the toner storage 81 to the area of space defined by the toner conveyer 82. In the toner storage 81, a stirring screw 85 is axially supported by the front surface of the front housing member 80A and the rear surface of the rear housing member 80B. The stirring screw 85 has its axial direction oriented in the front-rear direction. At a center of the stirring screw 85, mylar sheets 86 and air stirring paddles 87 are disposed. The mylar sheets 86 and the air stirring paddles 87 are elongate in radially outward directions. At the rear end of the stirring screw 85, bridge prevention paddles 88 are disposed. The bridge prevention paddles 88 are elongate in radially outward directions.

The partition plate 83 has an air hole 89 open at a position under the air stirring paddles 87. The bottom surface of the front housing member 80A is partially open through to the toner conveyer 82. This opening serves as a toner supply opening 90, through which toner conveyed from the toner conveyer 82 is discharged. In the toner conveyer 82, a conveyance screw 91 is axially supported by the front surface of the front housing member 80A and the rear surface of the rear housing member 80B. The conveyance screw 91 has its axial direction oriented in the front-rear direction. At a lower position on the front housing member 80A, a shutter 92 is disposed to cover the toner supply opening 90, which is disposed on the toner conveyer 82. On the front outer side of the front housing member 80A, a docking gear 93 is disposed. The docking gear 93 includes a group of gears to transmit driving force to the stirring screw 85 and the conveyance screw 91. The docking gear 93 is connected to a docking gear (not shown) of the apparatus main body 2, and this drives the stirring screw 85 and the conveyance screw 91 into rotation.

In the toner supply device 8A thus configured, when the stirring screw 85 is driven into rotation, this rotates the mylar sheets 86, which are above the partition plate 83, and the bridge prevention paddles 88, which are above the toner supply opening 84. Thus, by the rotation of the mylar sheets 86 and the bridge prevention paddles 88, the toner stored in the toner storage 81 is stirred. This eliminates or minimizes bridging and coagulation of the toner in the toner storage 81. This, in turn, ensures that the toner stored in the toner storage 81 is maintained in powder form and supplied to the toner conveyer 82 through the toner supply opening 84.

Then, the conveyance screw 91 in the toner conveyer 82 is rotated, and the toner supplied from the toner supply opening 84 is moved forward, away from the toner supply opening 84, by the thread of the conveyance screw 91 to the toner supply opening 90. Here, when the shutter 92 opens the toner supply opening 90, the toner conveyed to the toner supply opening 90 by the conveyance screw 91 is supplied to the developing device 63 through a toner conveyance member, not shown, that is connected to the developing device 63.

The rotation of the stirring screw 85 also rotates the air stirring paddles 87, which are above the air hole 89. Incidentally, the air hole 89 is disposed on the partition plate 83, which is above the toner conveyer 82, and thus communicates with the toner supply opening 90 through the toner conveyer 82. Specifically, when air flows into the toner conveyer 82 through the toner supply opening 90, the air then flows into the toner storage 81 through the air hole 89. Here, the air stirring paddles 87 above the air hole 89 rotate, as described above, so as to remove the toner above the air hole 89 and form an area of space. This promotes the inflow of air to the toner storage 81. Thus, when the amount of the toner remaining in the toner storage 81 is small, air is supplied to the toner storage 81 from outside, which eliminates or minimizes negative pressure in the toner storage 81. This stabilizes the amount of toner supply through the toner supply opening 90.

In the stirring screw 85, which ensures stirring of toner and stable supply of air, an exemplary number of each of the air stirring paddles 87 and the bridge prevention paddles 88 is four, and an exemplary number of the mylar sheets 86 is two, as shown in FIG. 2. However, FIG. 2 is not intended as limiting the numbers of the mylar sheets 86, the air stirring paddles 87, and the bridge prevention paddles 88. For example, the numbers of the air stirring paddles 87 and the bridge prevention paddles 88 may be different from one another.

Figure 4:
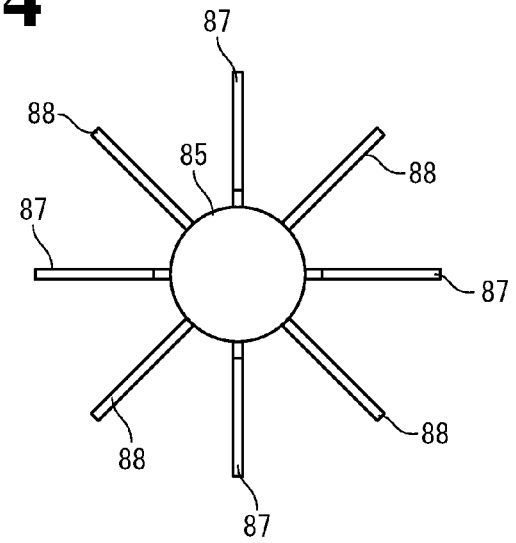
FIG. 4 is a view of a stirring screw in the toner supply device of the image forming apparatus according to the first embodiment, schematically illustrating another configuration of the stirring screw.

Also as shown in FIG. 2, the air stirring paddles 87 and the bridge prevention paddles 88 are disposed at the same positions in the circumferential direction of the stirring screw 85. Another possible example is shown in FIG. 4, where the air stirring paddles 87 and the bridge prevention paddles 88 are disposed at different positions in the circumferential direction of the stirring screw 85.

Figure 5:
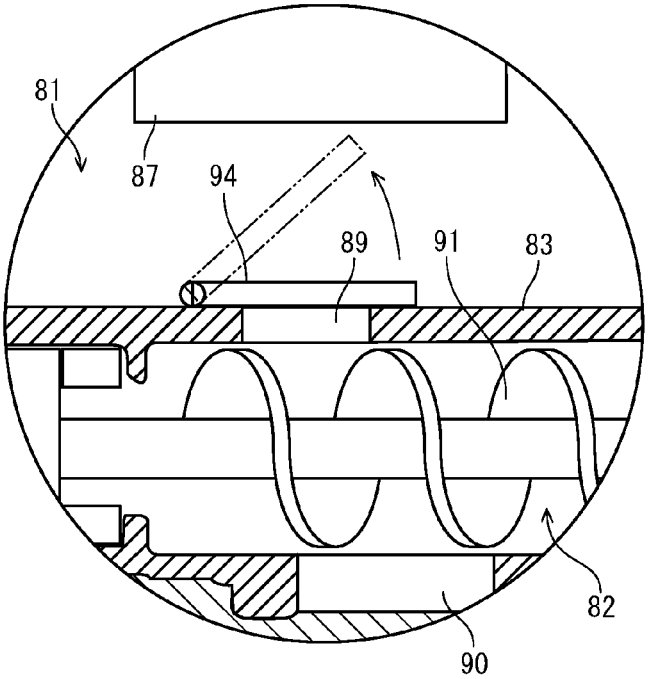
FIG. 5 is a view of the toner supply device of the image forming apparatus according to the first embodiment, schematically illustrating another configuration of the toner supply device.

Also in this embodiment, as shown in FIG. 5, it is possible to provide an air supply valve 94 over the air hole 89 to open and close in the toner storage 81. The air supply valve 94 opens and closes synchronously with the rotation of the air stirring paddles 87 so as to allow air to flow into the toner storage 81 through the air hole 89 while preventing flow of toner from the toner storage 81 to the toner conveyer 82 through the air hole 89.

That is, when the toner over the air hole 89 is removed by the rotation of the air stirring paddles 87 to result in an area of space, the air supply valve 94 is opened toward the toner storage 81, allowing air flowing through the toner supply opening 90 into the toner conveyer 82 to be supplied to the toner storage 81 through the air hole 89. When the toner is moved to the space over the air hole 89 by the rotation of the air stirring paddles 87, the toner in the toner storage 81 keeps the air supply valve 94 closed, thereby preventing flow of the toner from the toner storage 81 to the toner conveyer 82.

Second Embodiment

Figure 6:
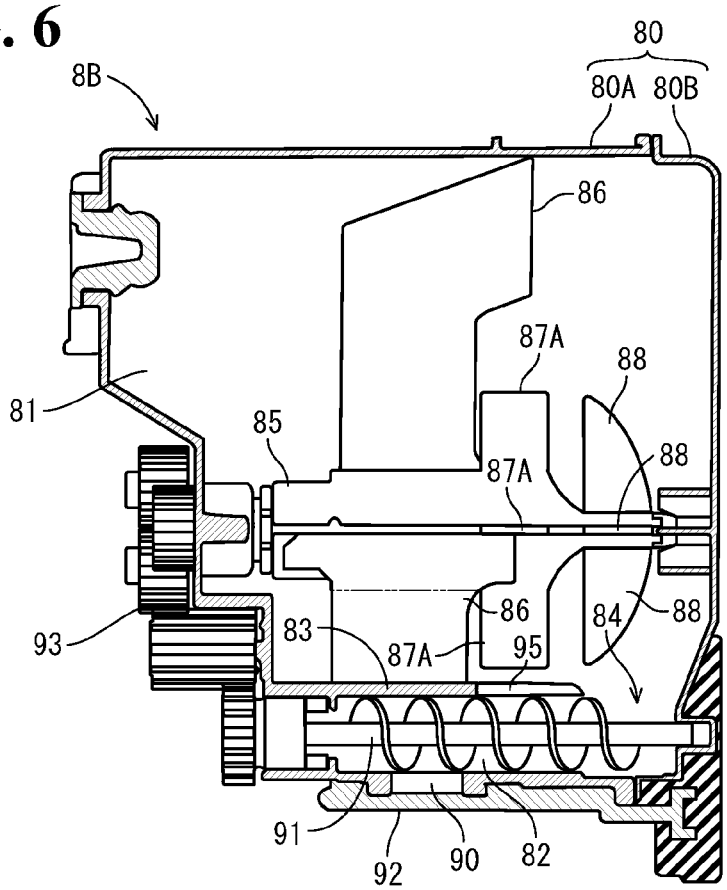
FIG. 6 is a cross-sectional view of a toner supply device of an image forming apparatus according to a second embodiment, schematically illustrating a configuration of the toner supply device.

An image forming apparatus according to the second embodiment of the present invention will be described below by referring to the accompanying drawings. The following description is mainly focused on a configuration of the toner supply device. FIG. 6 is a cross-sectional view of the toner supply device of the image forming apparatus according to the second embodiment, schematically illustrating a configuration of the toner supply device. The same reference numerals designate identical elements throughout FIG. 2 and FIG. 6, and will not be elaborated here.

Figure 7:
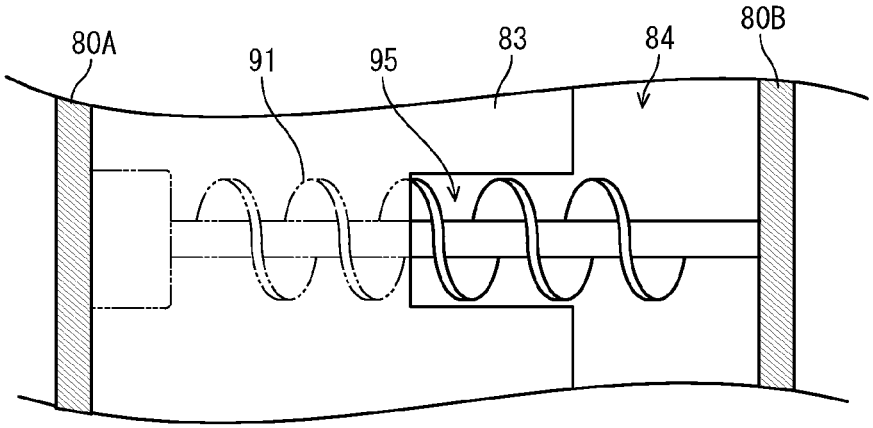
FIG. 7 is a plan view of a partition plate in the configuration of the toner supply device shown in FIG. 6, illustrating a configuration of the partition plate.

As shown in FIGS. 6 and 7, toner supply devices 8B are disposed in the image forming apparatus 1 according to this embodiment. As opposed to the toner supply devices 8A according to the first embodiment (see FIG. 2), the toner supply devices 8B each include a cutout 95, instead of the air hole 89, at the rear end of the partition plate 83. From the stirring screw 85, air stirring paddles 87A extend to immediately above the cutout 95. Thus, the cutout 95 serves as an air hole to connect the toner storage 81 and the toner conveyer 82 to one another, and the air stiffing paddles 87A promote inflow of air through the cutout 95. The cutout 95 and the air stiffing paddles 87A are disposed further forward than the toner supply opening 84.

The toner supply devices 8B thus configured are similar to the toner supply devices 8A according to the first embodiment in that air flowing through the toner supply opening 90 into the toner conveyer 82 is supplied to the toner storage 81 through the cutout 95 of the partition plate 83. Here, the air stirring paddles 87A immediately above the cutout 95 rotate to promote flow of air into the toner storage 81.

In the toner supply devices 8B, the cutout 95 is disposed at a position on the partition plate 83 that is slightly further rearward than the toner supply opening 90. This eliminates or minimizes leakage of toner from the toner storage 81 caused by the connection between the air hole 89 and the toner supply opening 90, which is the configuration of the toner supply devices 8A according to the first embodiment. Thus, the toner supply devices 8B have no need for adding the air supply valve 94 shown in FIG. 5 in an attempt to prevent toner leakage. Also in the toner supply devices 8B, it is the cutout 95 that serves as the air hole to connect the toner storage 81 and the toner conveyer 82 to one another. This ensures facilitated production as compared with the air hole 89 of the toner supply devices 8A.

The embodiment shown in FIG. 6 is not intended in a limiting sense. Similarly to the first embodiment, the numbers of the air stirring paddles 87A and the bridge prevention paddles 88 may be different from one another. Similarly to FIG. 4 according to the first embodiment, the air stiffing paddles 87A and the bridge prevention paddles 88 may be disposed at different positions in the circumferential direction of the stiffing screw 85.

Third Embodiment

Figure 8:
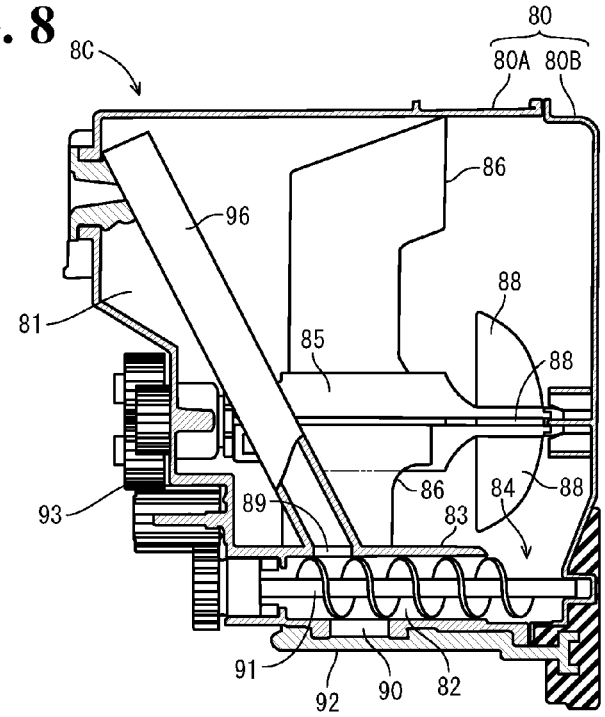
FIG. 8 is a cross-sectional view of a toner supply device of an image forming apparatus according to a third embodiment, schematically illustrating a configuration of the toner supply device.

An image forming apparatus according to the third embodiment of the present invention will be described below by referring to the accompanying drawings. The following description is mainly focused on a configuration of the toner supply device. FIG. 8 is a cross-sectional view of the toner supply device of the image forming apparatus according to the third embodiment, schematically illustrating a configuration of the toner supply device The same reference numerals designate identical elements throughout FIG. 2 and FIG. 8, and will not be elaborated here.

As shown in FIG. 8, toner supply devices 8C are disposed in the image forming apparatus 1 according to this embodiment. The toner supply devices 8C have an addition to the toner supply devices 8A according to the first embodiment (see FIG. 2). The addition is an air supply pipe 96, which connects to the air hole 89 of the partition plate 83 and extends between the partition plate 83 and an area of space above the toner storage 81. Also, the air stirring paddles 87 are omitted. Specifically, the air supply pipe 96 extends in a rearward-downward direction from an upper area of space of the toner storage 81 to the air hole 89 of the partition plate 83. The air supply pipe 96 is open on its upper end and communicates with the air hole 89 on the lower end. This ensures that air flowing into the toner conveyer 82 is supplied to the upper area of space of the toner storage 81.

In the toner supply devices 8C thus configured, air flowing through the toner supply opening 90 into the toner conveyer 82 is supplied to the toner storage 81 through the air hole 89 and the air supply pipe 96 of the partition plate 83. The toner supply devices 8C are different from the toner supply devices 8A according to the first embodiment in that the air supply pipe 96 is open at the upper area of space of the toner storage 81. This eliminates or minimizes leakage of toner from the toner storage 81 caused by the connection between the air hole 89 and the toner supply opening 90. Further, since this configuration guides the air to the upper area of space of the toner storage 81, the air is directly supplied to the space that results from a reduction in the toner stored in the toner storage 81. This eliminates the need for the air stirring paddles 87, which are provided in the toner supply devices 8A according to the first embodiment.

Figure 9:
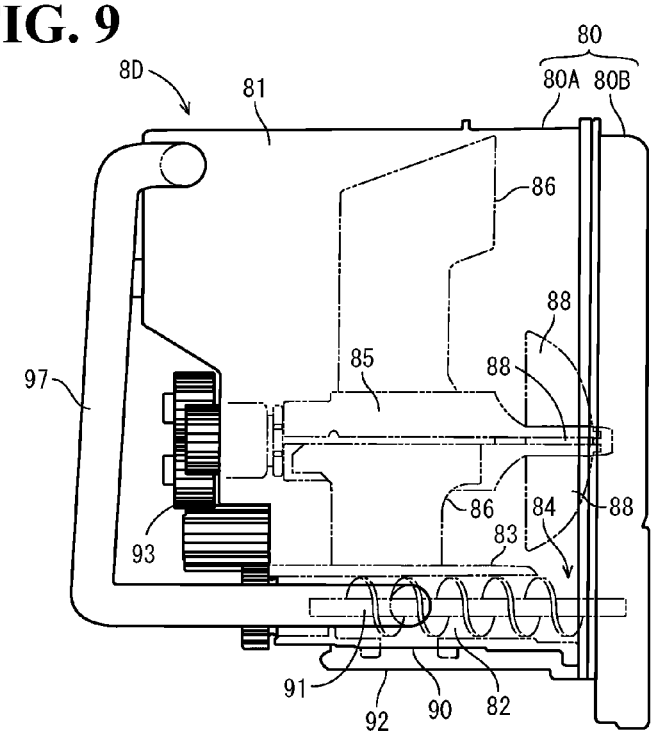
FIG. 9 is a cross-sectional view of the toner supply device of the image forming apparatus according to the third embodiment, schematically illustrating another configuration of the toner supply device.

While in this embodiment the air supply pipe 96 is disposed in the toner storage 81 as shown in FIG. 8, this should not be construed in a limiting sense. Any other configuration is possible insofar as air is supplied from the toner conveyer 82 to the upper area of space of the toner storage 81. An example is a toner supply device 8D shown in FIG. 9. The toner supply device 8D includes an air supply pipe 97 disposed outside a housing 2. At one end, the air supply pipe 97 connects to an opening of the toner conveyer 82 in the housing 2. At the other end, the air supply pipe 97 connects to an opening of the toner storage 81 in the housing 2.

While the image forming apparatuses according to the embodiments have been illustrated as image forming apparatuses of the intermediate transfer system, the image forming apparatuses according to the embodiments may be of another system insofar as the toner supply devices according to the embodiments are provided. Examples of other systems include the direct transfer system and the rotary system. Insofar as the toner supply devices according to the embodiments are provided, the image forming apparatuses according to the embodiments may be MFPs (Multifunction Peripherals) equipped with the photocopier capability, the scanner capability, the printer capability, and the facsimile capability. Other examples include a printer, a photocopier, and a facsimile.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A toner supply device comprising:

a toner storage configured to store toner;

a toner conveyor configured to convey the toner stored in the toner storage;

a first toner supply opening through which the toner is supplied to the toner conveyer, the toner conveyor occupying an area of space different from an area of space occupied by the toner storage, and the toner conveyer being configured to convey the toner stored in the toner storage so as to supply the toner from the first toner supply opening to a developing device;

a second toner supply opening through which the toner is supplied from the toner conveyer to the developing device, the second toner supply opening being disposed at a position not overlapping with the first toner supply opening in a vertical direction;

a partition plate which partitions the toner storage and the toner conveyor into their respective different areas of space; and an air passage comprising a hole which functions as the air passage and which is formed in the partition plate, the air passage being disposed at a position different from a position at which the first toner supply opening is disposed, and the air passage connecting the area of space of the toner storage and the area of space of the toner conveyer to one another so as to allow air, which flows through the second toner supply opening into the area of space of the toner conveyer, to be supplied to the toner storage through the air passage, wherein the hole which functions as the air passage is formed in the partition plate at a position opposing the second toner supply opening, and wherein a portion of the hole overlaps with the second toner supply opening in the vertical direction.

2. The toner supply device according to claim 1, wherein the second toner supply opening is disposed further downstream than the first toner supply opening in a direction in which the toner conveyer conveys the toner.

3. The toner supply device according to claim 2, further comprising an air supply valve configured to prevent the toner from flowing from the toner storage into the air passage.

4. An image forming apparatus comprising the toner supply device of claim 1.

5. The toner supply device according to claim 1, wherein the toner storage comprises a paddle configured to rotate in a vicinity of the air passage so as to remove the toner in the vicinity of the air passage and thereby form an area of space for the air to enter the toner storage via the air passage.

6. The toner supply device according to claim 1, further comprising an air supply valve configured to prevent the toner from flowing from the toner storage into the air passage.

7. A toner supply device comprising:

a toner storage configured to store toner;

a toner conveyor configured to convey the toner stored in the toner storage;

a first toner supply opening through which the toner is supplied to the toner conveyer, the toner conveyor occupying an area of space different from an area of space occupied by the toner storage, and the toner conveyer being configured to convey the toner stored in the toner storage so as to supply the toner from the first toner supply opening to a developing device;

a second toner supply opening through which the toner is supplied from the toner conveyer to the developing device, the second toner supply opening being disposed at a position not overlapping with the first toner supply opening in a vertical direction;

a partition plate which partitions the toner storage and the toner conveyor into their respective different areas of space;

an air passage comprising a hole which functions as the air passage and which is formed in the partition plate, the air passage being disposed at a position different from a position at which the first toner supply opening is disposed, and the air passage connecting the area of space of the toner storage and the area of space of the toner conveyer to one another so as to allow air, which flows through the second toner supply opening into the area of space of the toner conveyer, to be supplied to the toner storage through the air passage; and a paddle configured to rotate in a vicinity of the air passage so as to remove the toner in the vicinity of the air passage and thereby form an area of space, wherein the hole which functions as the air passage is formed in the partition plate at a position opposing the second toner supply opening, and wherein a portion of the hole overlaps with the second toner supply opening in the vertical direction.

8. The toner supply device according to claim 7, further comprising an air supply valve configured to prevent the toner from flowing from the toner storage into the air passage.

9. The toner supply device according to claim 7, wherein the toner conveyer is disposed below the toner storage, and wherein the air passage further comprises an air supply pipe connecting an upper area of space of the toner storage and the toner conveyer to one another.

10. The toner supply device according to claim 7, wherein the second toner supply opening is disposed further downstream than the first toner supply opening in a direction in which the toner conveyer conveys the toner.

11. An image forming apparatus comprising the toner supply device of claim 7.

* * * * *